US005388534A

United States Patent [19]

Doron et al.

[11] Patent Number: 5,388,534

[45] Date of Patent: Feb. 14, 1995

[54] METHOD OF AND MEANS FOR PRODUCING COMBUSTIBLE GASES FROM LOW GRADE SOLID FUEL

[75] Inventors: Benjamin Doron, Jerusalem; Daniel Goldman, Tel Aviv; Eli Yaffe, Givatayim, all of Israel

[73] Assignee: Ormat Inc., Sparks, Nev.

[21] Appl. No.: 82,818

[22] Filed: Jun. 28, 1993

Related U.S. Application Data

[63] Continuation of Ser. No. 993,445, Dec. 16, 1992, abandoned, which is a continuation of Ser. No. 834,871, Feb. 13, 1992, abandoned, which is a continuation-in-part of Ser. No. 827,276, Jan. 29, 1992, abandoned.

[51] Int. Cl.[6] ..... F23B 7/00

[52] U.S. Cl. ..... 110/233; 48/101; 48/210; 110/229; 110/234; 110/346; 110/347

[58] Field of Search ..... 110/346, 347, 229, 233, 110/234; 48/101, 210; 201/12

[56] References Cited

U.S. PATENT DOCUMENTS

| | | | |
|---|---|---|---|
| 4,110,064 | 8/1978 | Vorona et al. . | |
| 4,211,606 | 7/1980 | Ponomarev et al. . | |
| 4,326,471 | 4/1982 | Rohrbach et al. | 110/229 X |
| 4,432,290 | 2/1984 | Ishii et al. | 110/229 X |
| 4,700,639 | 10/1987 | Eterson et al. . | |
| 4,917,024 | 4/1990 | Marten et al. | 110/229 X |

FOREIGN PATENT DOCUMENTS 68149 3/1983 Israel .

OTHER PUBLICATIONS

G. Esterson et al., *Generation Of Energy From Shale Of Israel: The Genesis Process.* The Energy Center, The Hebrew University. Sep. 1984, p. 40.

*Primary Examiner*—Edward G. Favors

*Attorney, Agent, or Firm*—Sandler, Greenblum & Bernstein

[57] ABSTRACT

Combustible gases are produced from a solid fuel by pyrolizing the fuel in a pyrolyzer containing a low grade solid fuel producing combustible gases, and carbonaceous material that is combusted in a furnace to produce hot products that include hot flue gases and particulate material. The hot products are separated into a plurality of streams, one of which contains comparatively coarse ash which is directed into the pyrolyzer for effecting the pyrolyzation of the fuel. A stream of reaction gases is applied to the pyrolyzer in such a way that the stream of reaction gases bubbles through the carbonaceous material in the pyrolyzer without fluidizing such material. In effect, the reaction gases activate the void fraction in the pyrolyzer thereby reducing the residence time of the material therein. In one embodiment of the invention, the combustible gas produced by the pyrolyzer is burned in a combustion chamber of a boiler that produces boiler flue gases which constitute the reaction gases applied to the pyrolyzer. In a further embodiment, the combustible products produced by the furnace are separated into a stream containing flue gases and ash. At least a part of the latter stream may constitute the reaction gases applied to the pyrolyzer.

48 Claims, 3 Drawing Sheets

METHOD OF AND MEANS FOR PRODUCING COMBUSTIBLE GASES FROM LOW GRADE SOLID FUEL

This application is a continuation of application No. 07/993,445 filed Dec. 16, 1992, now abandoned, which is a continuation of application Ser. No. 07/834,871, filed Feb. 13, 1992, now abandoned; which is a continuation-in-part of application Ser. No. 07/827,276, filed Jan. 29, 1992, now abandoned.

TECHNICAL FIELD

This invention relates to a method of and means for producing combustible gases from low grade solid fuel such as oil shale and the like.

BACKGROUND OF THE INVENTION

Oil shale is found throughout the world and would constitute a plentiful and relatively inexpensive fuel if techniques were available for quickly and inexpensively processing the oil shale into combustible gases. One approach to processing oil shale into combustible gases is disclosed in U.S. Pat. No. 4,211,606 (the disclosure which is hereby incorporated by reference). In this patent, oil shale is heated in a dryer using clean, hot flue gases producing heated shale that is applied to a pyrolyzer. The heated shale is contacted and further heated in the pyrolyzer with ash from the hot flue gases to produce combustion products, and carbonaceous material that is added to a gasifier. Hot gases, ash, and steam are applied to the gasifier such that the carbonaceous material produces further combustible gases. The residue of the gasifier is extracted and applied to what the patent terms an air jet furnace, details of which are disclosed in U.S. Pat. No. 4,110,064 which is also incorporated by reference.

The air jet furnace produces products in the form of hot flue gases whose major constituent is carbon dioxide, and ash particulate which is applied to a separator which separates the products into a stream of hot gases and comparatively coarse ash, and a stream of hot gas and comparatively fine ash. A portion of the comparatively fine ash is applied to the gasifier and the stream of hot gases and fine ash are applied to a further separator that produces the clean flue gases that serve to heat the shale in the dryer.

A derivative of the apparatus described above has apparently been used in two plants in the U.S.S.R. in 1990 and 1991. As presently understood, the actual design eliminates the gasifier. Oil shale is fed into a pyrolyzer wherein pyrolyzation takes place producing combustible products which are extracted, and carbonaceous material after a predetermined residence time of the shale in the pyrolyzer. This material is supplied to an air jet furnace wherein combustion takes place producing hot flue gases, and particulate that is applied to a separator which separates the flow into two streams, one of which contains comparatively coarse ash, and the other of which contains flue gases and comparatively fine ash. The comparatively coarse ash is applied to the pyrolyzer which produces pyrolysis gas at a temperature in excess of 400° C. Such gas contains combustible products, steam, and carbon compounds. The stream containing the comparatively fine ash and flue gases is applied to another separator producing relatively clean flue gases which nevertheless still contain a relatively large quantity of ash. These gases so produced together with the pyrolysis gas are both applied to a burner that is a part of the combustion chamber of a boiler where combustion takes place, the boiler producing steam that may be used for generating electricity.

Even when the pyrolyzer is constructed as a rotating drum, the residence time for the shale in the pyrolyzer to become completely pyrolyzed is relatively long which results in excessively large physical size, great complexity in the equipment, and high cost. It is therefore an object of the present invention to provide a new and improved design for producing combustible gases from low grade solid fuel which reduces the size of the pyrolyzer by reducing the residence time of the low grade fuel therein.

BRIEF DESCRIPTION OF THE INVENTION

The present invention produces combustible gases from a solid fuel by pyrolyzing the fuel in a pyrolyzer to produce the combustible gases and carbonaceous material. This material is combusted in a furnace to produce combustion products that include hot flue gases and particulate material. The combustion products are separated into a plurality of streams, one of which contains comparatively coarse ash which is directed into the pyrolyzer. A stream of reaction gases is applied to the pyrolyzer in such a way that the stream of reaction gases bubbles through the carbonaceous material in the pyrolyzer without fluidizing such material. Alternatively, the carbonaceous material can be fluidized by the reaction gases. Bubbling is preferred, however, because the amount of particulate contained in the combustible gases exiting the pyrolyzer is relatively small. In either case, the reaction gases activate the void fraction in the pyrolyzer thereby reducing the residence time of the material therein.

In one embodiment of the invention, the combustible gases produced by the pyrolyzer are burned in a combustion chamber of a boiler, for example, that produces boiler flue gases which constitute the reaction gases applied to the pyrolyzer. In another embodiment, at least a portion of a stream containing flue gases and comparatively fine ash, separated from combustion products produced by the furnace, may constitute the reaction gases.

In accordance with the present invention, the rate of bubbling or fluidizing can be controlled such that the amount of particulate reaching the combustion chamber of the boiler, if used, from the pyrolyzer will be sufficient to capture oxides of sulfur and/or other sulfur compounds present in the combustion gases coming from the pyrolyzer. Such capture is efficient because the temperature in the combustion chamber of the boiler is optimal for a reaction such as $CaCO_3+\frac{1}{2}O_2+SO_2 \rightarrow CaSO_4+CO_2$ to take place.

BRIEF DESCRIPTION OF THE DRAWINGS

Embodiments of the present invention are shown by way of the example in the accompanying drawings wherein.

DETAILED DESCRIPTION

Figure 1:
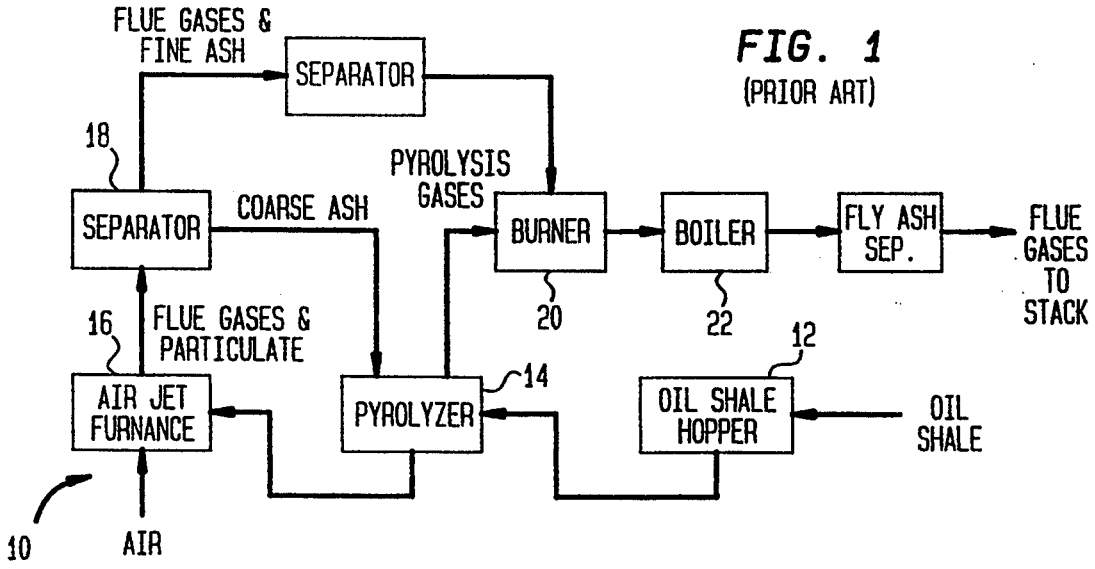
FIG. 1 (PRIOR ART)
FIG. 1 is a block diagram which represents, in a schematic way, existing power plants for producing combustible gases from low grade solid fuel such as oil shale.

Referring now to FIG. 1, reference numeral 10 designates apparatus for producing combustible products from a low grade solid fuel such as oil shale. Ground oil shale is usually applied to oil shale hopper 12 having a screw feed device (not shown) for supplying shale from hopper 12 to pyrolyzer 14 where pyrolysis takes place under the influence of hot ash and combustion products applied to the pyrolyzer. Generally, the pyrolyzer operates in the range of 400–600° C. In response, the pyrolyzer produces pyrolysis gases in the form of steam and combustible gases in excess of 400° C.

The carbonaceous material formed in pyrolyzer 14 is fed by a screw conveyer (not shown) to air jet furnace 16 wherein combustion of the carbonaceous material takes place in the presence of ambient air supplied to the furnace. The outputs of the furnace are products of combustion comprising flue gases and particulate material which are applied to separator 18. Separator 18 is effective to divide the flow into at least two streams, one of which contains hot, comparatively coarse ash, and another of which contains hot flue gases and comparatively fine ash.

Ash from the first stream is applied to the pyrolyzer and supplies the heat by which pyrolysis takes place. The other stream containing the hot flue gases and comparatively fine ash is applied to a further separator to remove additional ash before the flue gases are applied to burner 20. Even so, a relatively large amount of ash remains in the gases.

The burner is shown schematically as a single element for effecting the combustion of the pyrolysis gases produced by pyrolyzer 14 with the flue gases containing carbon dioxide being shown as applied to the burner. The result is that combustion takes place in the combustion chamber of boiler 22 which usually is a steam boiler for producing steam used to generate electricity. The flue gases produced by the combustion chamber in the boiler are applied to a fine ash separator for separating comparatively fine ash, and the clean flue gases that exit the separator are applied to a stack.

Figure 2:
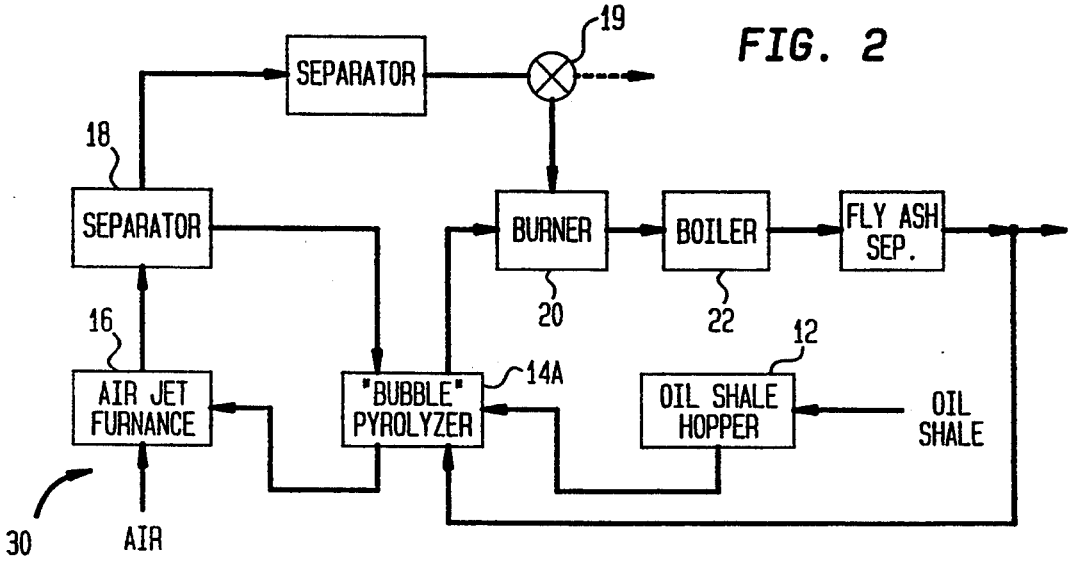
FIG. 2 is a block diagram of a first embodiment of the present invention.

In the embodiment of the invention indicated by reference 30 in FIG. 2, which is presently considered to be the best mode of carrying out the invention, some of the relatively clean flue gases at the output of the fine ash separator on the boiler are applied to pyrolyzer 14A (the other components in this embodiment being substantially the same as corresponding components in embodiment 10). These gases "bubble" through the carbonaceous material contained in the pyrolyzer without fluidizing this material. In other words, the flue gases applied to pyrolyzer 14A are not of sufficient volume and pressure to convert the pyrolyzer into a fluidized bed. Rather, the flue gases applied to the pyrolyzer activate the void fraction in the pyrolyzer and speed up the pyrolysis therein. As a result, the residence time in the material pyrolyzer is reduced. It is believed that the reduction in time may be by a factor as high as 5 to 1 as compared to the pyrolyzer shown in FIG. 1. In this embodiment, valve 19 can be used to divert gas exiting separator 17 to permit the use of the diverted gas for other purposes, such as separating ash contained therein for other uses.

Figure 3:
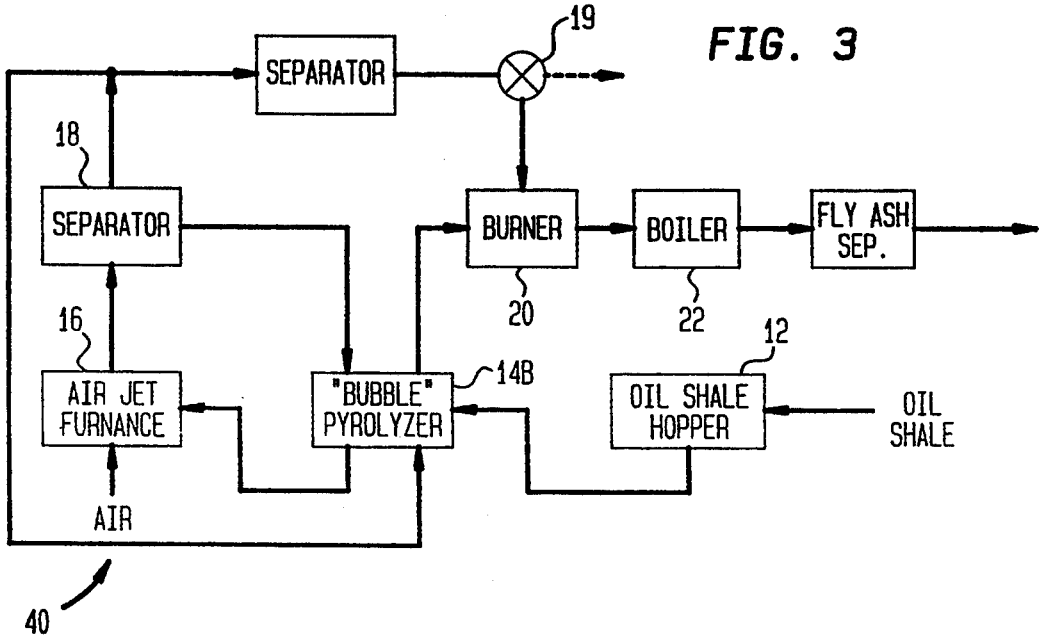
FIG. 3 is a block diagram of a second embodiment of the present invention.

In embodiment 40 of the present invention shown in FIG. 3, some of the products of combustion produced by separator 18 are diverted from burner 20 into pyrolyzer 14B. As indicated previously, these products of combustion bubble their way through the carbonaceous material in the pyrolyzer without fluidizing the same. As described above, the products of combustion activate the void fraction in the pyrolyzer reducing the residence time of the material. Also in this embodiment, valve 19 can be used to divert gas exiting separator 17 for other uses as indicated above.

While the invention is described in connection with utilizing low grade fuel such as oil shale, the invention is applicable to other types of low grade fuel such as peat.

Furthermore, while the gases in embodiments 30 and 40 are described as "bubbling" through the carbonaceous material contained in the pyrolyzer, the carbonaceous material alternatively can be fluidized by the gases. Bubbling is usually to be preferred because the amount of particulate in the combustible gases exiting the pyrolyzer is relatively small. However, the rate of bubbling or fluidizing can be controlled, in accordance with the present invention, such that the amount of particulate reaching the combustion chamber of the boiler, if used, from the pyrolyzer will be sufficient to capture oxides of sulfur and/or other sulfur compounds present during the combustion of gases coming from the pyrolyzer. Such capture is efficient because the temperature in the combustion chamber of boiler 22 is optimal for a reaction such as $CaCO_3+\frac{1}{2}O_2+SO_2 \rightarrow CaSO_4+CO_2$ to take place. Furthermore, if preferred, the amount of particulate reaching the combustion chamber from the pyrolyzer can be controlled for facilitating the absorption of sulfur compounds originating from the combustion of other fuels rich in sulfur that are burned simultaneously in the same combustion chamber with the pyrolyzer gases.

Additionally, while the specification refers to oil shale or other low grade fuel as entering the pyrolyzer for pyrolysis, if preferred, the oil shale or other low grade fuel may be mixed or introduced into the pyrolyzer together with another sulfur rich fuel. In such case, the capture of oxides of sulfur and/or other sulfur compounds during the combustion of the pyrolysis gases by particulate exiting the pyrolyzer with the gases will be efficient. Furthermore, the above-mentioned sulfur rich fuel may also be introduced into the furnace or air-jet furnace, if preferred, in addition to be introduced into the pyrolyzer in a mixture, or together with the oil shale or other low grade fuel. Alternatively, the sulfur rich fuel can be introduced into the furnace or air-jet furnace, if preferred, instead of being introduced into the pyrolyzer. The other fuel rich in sulfur previously mentioned may be solid, liquid or gaseous. However, when the fuel is mixed with the shale, or is introduced directly into the pyrolyzer with the shale, only solid or liquid fuel would be used.

If the oil shale used is not of sufficient quality to provide the required temperature in the air jet furnace (presently, approximately 700° C. is considered optimum), coal or other fuels can be added to the air jet furnace for ensuring operation at the required temperature. Alternatively, or in addition, the air or gases entering the air jet furnace can be preheated by spent ash that exits the air furnace.

The present invention also provides a method of and means for improving raw phosphates (i.e., phosphates found in many places in the world containing more than about 1–1.5% by weight of organic material) by eliminating substantially all organic material. According to the invention, apparatus disclosed in the present application, or apparatus disclosed in U.S. Pat. No. 4,211,606 can be used. Alternatively, apparatus disclosed in U.S. Pat. No. 4,700,639, the disclosure of which is hereby incorporated by reference, can be used. At present, the best mode of the present invention for improving raw phosphates, is apparatus disclosed in the present application, wherein a pyrolyzer converts most of the organic matter contained in the phosphates into gas.

Conventional methods of raw phosphate improvement can handle phosphates containing up to only 1 to 1.5% by weight of organic matter. Improved results can be obtained by baking the phosphates at a temperature of approximately 900° C. so that most of organic matter is consumed. Such baking, however, will not be sufficient to deal with phosphates having a higher organic matter content.

Figure 4:
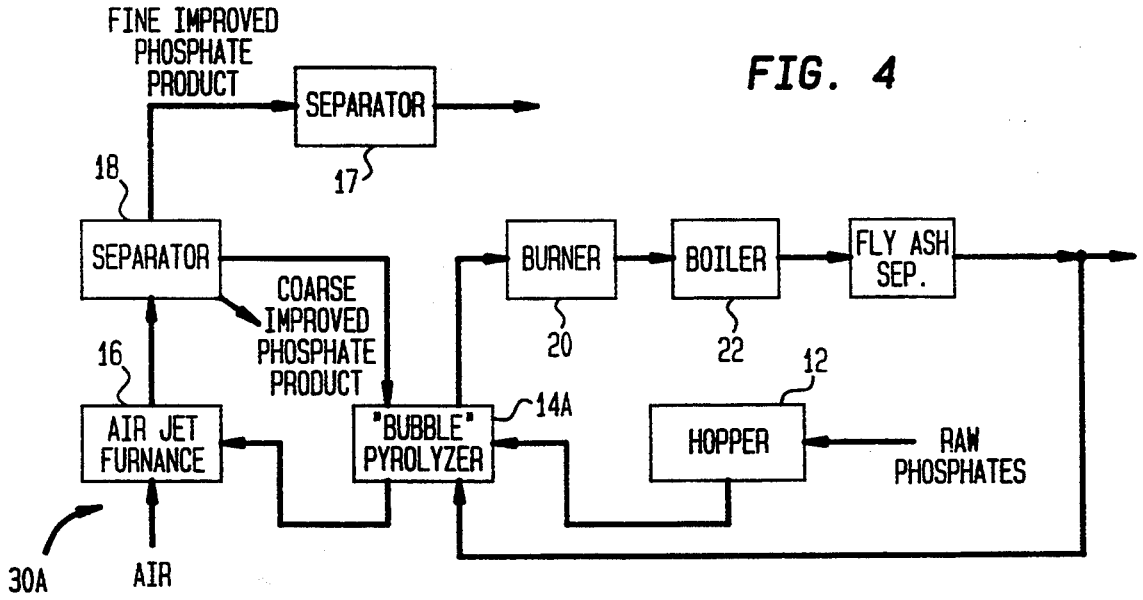
FIG. 4 is a block diagram of a third embodiment of the invention for removing organic material from phosphates.
Figure 5:
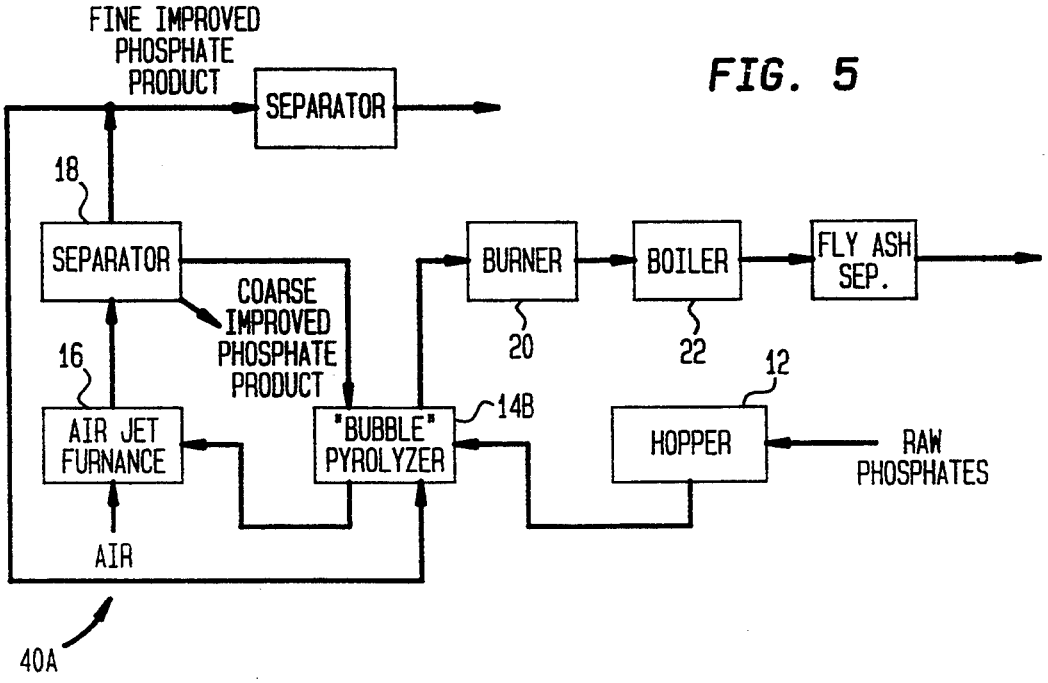
FIG. 5 is a block diagram of a modification of the third embodiment.
Figure 7:
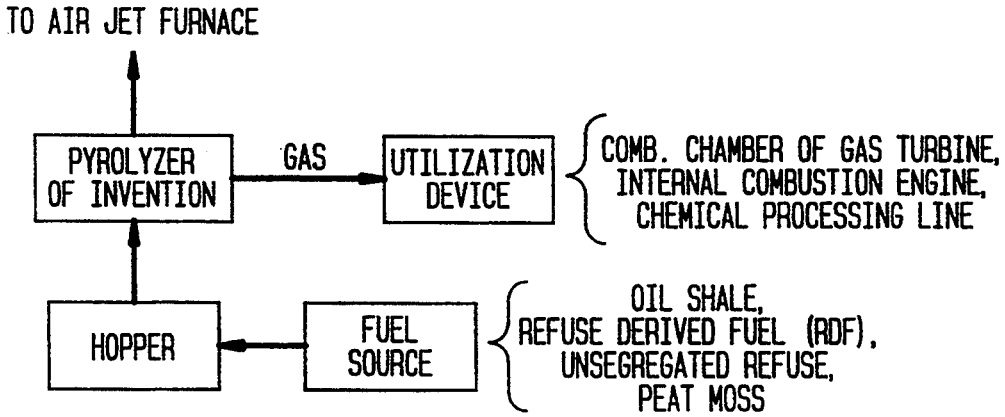
FIG. 7 is a schematic diagram that shows the various types of fuel that can be used in the present invention, and the various ways in which gases produced can be utilized.

The preferred method for improving raw phosphates having higher organic content, according to the present invention, is to utilize at least a two-stage process of (1) pyrolysis and (2) baking. According to the present invention, pyrolysis is first carried out on the raw phosphates for converting organic matter contained in the phosphates into combustible gases which are extracted from the pyrolyzer and made available for combustion as shown in FIGS. 4 and 5. Alternatively, the combustible gases can be used for other purposes such as shown in FIG. 7. Phosphates remaining in the pyrolyzer after pyrolyzing is effected are removed and baked in an air jet furnace which, preferably, is operated at a relatively high temperature, approximately 900° C. such that any organic material remaining in the phosphates is combusted, and/or any other processes requiring such a high temperature in the improvement process of the raw phosphates may take place. Consequently, the phosphates exiting the air jet furnace will contain only a relatively small amount of organic matter and are thus improved.

A portion of the improved phosphates exiting the air furnace is extracted as the product of the process, while a further portion is applied to the pyrolyzer for heating phosphates therein during the pyrolysis process. In other words, a portion of the particulate improved phosphates exiting the air furnace is supplied to the pyrolyzer in a manner similar to that in which the ash exiting the air furnace is supplied to the pyrolyzer in the previous embodiments of the present invention, or in the manner in which the apparatus disclosed in U.S. Pat. No. 4,211,606 provides heat for the pyrolysis process.

FIGS. 4 and 5 show variations in the present invention for the production of improved phosphates and combustible gases that are used in a burner of a power plant. Other uses for the combustible gases are shown in FIG. 7. Such other uses include burning the gases in the combustion chamber of a gas turbine, or internal combustion engine such as a diesel engine that may drive a generator and produce power, or utilizing the gases as raw material in a chemical production line. Separator 17 shown in FIGS. 4 and 5 is optional, and its use depends on the ultimate use of the combustible gases.

If the amount of organic matter in the phosphates reaching the air jet furnace from the pyrolyzer is insufficient for permitting the air jet furnace to operate at the high temperature required, coal or any other fuel can be added to the air jet furnace to ensure that the required high temperatures are achieved in the air furnace. Alternatively, a portion of the gases exiting the pyrolyzer can be added to the air jet furnace for ensuring that the required high temperatures are reached.

Use of a dryer in a manner analogous to that shown in U.S. Pat. No. 4,211,606 brings about an improvement in the calorific value of the gases exiting the pyrolyzer and saves energy expended in the system on the whole. Alternatively, the air or gases entering the air jet furnace can be preheated by the phosphates exiting the air furnace.

Figure 6:
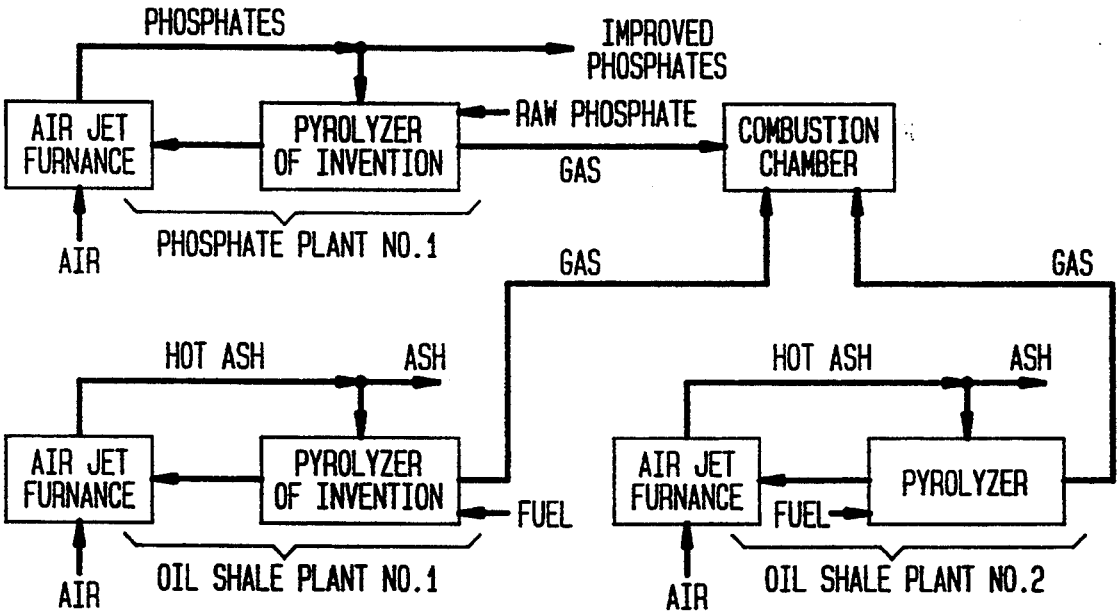
FIG. 6 is a block diagram of a combined oil shale and phosphate plant according to the present invention.

In a further embodiment of the present invention, a plurality of plants can be used for providing gases for a utilization device such as the combustion chamber of a power plant, or for other used shown in FIG. 7. When the gases are used to provide fuel for a power plant, one or a number of oil shale processing plants, analogous to the ones specified in the above described embodiment of the present invention or that described in U.S. Pat. No. 4,211,606 or in U.S. Pat. No. 4,700,639, can be used in conjunction with one or a number of raw phosphate processing plants described above as shown schematically in FIG. 6. In such a manner, raw phosphates, usually having a varying calorific value can be processed such that combustible gases exiting the raw phosphate processing plants, can be supplied to a combustion chamber for combustion to which gases exiting oil shale processing plants, usually having a reasonably fixed calorific value are also supplied. If preferred, the gases produced by the phosphate processing plants and the gases produced by the oil shale processing plants can be supplied to separate combustion chambers.

Alternatively, if some of the raw phosphates have a reasonably fixed calorific value, these phosphates can also be processed in a separate plant or plants, with the phosphates having a varying calorific value being processed in other processing plants. Gases produced from these processing plants can be supplied to a common combustion chamber, or to separate combustion chambers if preferred.

Furthermore, where the raw phosphates and oil shale are extracted from the same or adjacent layers (shale layers are often above or below phosphate layers), a single conveyer may be used for conveying the oil shale and/or phosphates to the appropriate processing plants. In such a way, separate conveyer systems are eliminated.

The advantages and improved results furnished by the method and apparatus of the present invention are apparent from the foregoing description of the preferred embodiment of the invention. Various changes and modifications may be made without departing from the spirit and scope of the invention as described in the appended claims.

What is claimed is:

1. A method for producing combustible gases from a solid fuel comprising:

a) pyrolyzing said fuel in a pyrolyzer to produce said combustible gases and carbonaceous material;

b) combusting said carbonaceous material from said pyrolyzer in a furnace to produce combustion products that include hot flue gases and ash particulate;

c) separating said combustion products into a plurality of streams, one of which contains comparatively coarse ash and another stream which contains flue gases and fine ash;

d) directing said comparatively coarse ash into said pyrolyzer; and e) applying to said pyrolyzer a stream of reaction gases in such a way that said stream of reaction gases bubble through the carbonaceous material in said pyrolyzer without fluidizing such material for activating the void fraction in the pyrolyzer thereby reducing the residence time of material in the pyrolyzer.

2. A method according to claim 1 wherein said combustible gas is burned in a combustion chamber of a boiler that produces flue gases which constitutes said reaction gases applied to said pyrolyzer.

3. A method according to claim 1 wherein at least some of said other stream constitutes said reaction gases applied to said pyrolyzer.

4. A method according to claim 3 wherein at least some of said another stream is available for application to a combustion chamber of a boiler wherein said combustible gases are burned.

5. Apparatus for producing combustible gases from a solid fuel comprising:

a) a pyrolyzer for pyrolyzing said fuel to produce said combustible gases and carbonaceous material;

b) an air furnace for receiving carbonaceous material from said pyrolyzer-and producing hot products that includes hot flue gases and ash particulate;

c) a separator for separating said hot products into a plurality of streams, one of which contains comparatively coarse ash, and another stream containing flue gases and comparatively fine ash;

d) means for directing said comparatively coarse ash produced by said separator into said pyrolyzer;

e) a source of reaction gases; and f) means for applying a stream of said reaction gases to said pyrolyzer such that said reaction gases bubble through the carbonaceous material in said pyrolyzer without fluidizing the same whereby the void fraction in the pyrolyzer is activated and the residence time of the material in the pyrolyzer is reduced.

6. Apparatus according to claim 5 including a combustion chamber for burning said combustible gases for producing flue gases which constitute said source of reaction gases.

7. Apparatus according to claim 5 wherein at least a portion of said another stream constitutes said source of reaction gases.

8. Apparatus according to claim 7 including means for applying at least a portion of said another stream to said combustion chamber wherein said combustible gases are burned.

9. Apparatus according to claim 5 including utilization device for utilizing said combustible gases.

10. Apparatus according to claim 9 wherein said utilization device is a combustion chamber of a gas turbine.

11. Apparatus according to claim 9 wherein said utilization device is an internal combustion engine.

12. Apparatus according to claim 9 wherein said utilization device is a chemical processing line.

13. Apparatus according to claim 9 wherein said fuel is oil shale.

14. Apparatus according to claim 5 wherein said fuel is refuse derived fuel (RDF).

15. Apparatus according to claim 5 wherein said fuel is unsegregated refuse.

16. Apparatus according to claim 5 wherein said fuel is peat.

17. A method according to claim 1 including the step of burning said combustion gases in a combustion chamber of an internal combustion engine.

18. A method according to claim 1 including the step of burning said combustion gases in a combustion chamber of a gas turbine.

19. A method according to claim 1 including the step of utilizing said combustion gases in a chemical processing line.

20. A method for improving raw phosphates containing organic material comprising the steps of introducing raw phosphates into a pyrolyzer which pyrolyzes organic material in the raw phosphates and produces combustible gases and carbonaceous material, heating carbonaceous material extracted from the pyrolyzer in a furnace to produce hot improved phosphates, and adding a portion of said hot phosphates to said pyrolyzer.

21. A method according to claim 1 including the step of adding sulfur-rich fuel to said solid fuel before the latter is pyrolyzed.

22. A method according to claim 1 including the step of introducing sulfur-rich fuel into said pyrolyzer while pyrolyzing said solid fuel.

23. A method according to claim 1 including the step of introducing sulfur-rich fuel into said furnace.

24. A method according to claim 1 wherein said combustible gas is burned in a combustion chamber of a boiler.

25. A method according to claim 24 including the step of introducing sulfur-rich fuel into said combustion chamber.

26. A method according to claim 1 including the step of burning said combustible gases.

27. A method according to claim 26 including the step of adding sulfur rich fuel to said combustible gases while the latter burn.

28. Apparatus according to claim 5 including means for mixing sulfur-rich fuel with said solid fuel before the solid fuel is pyrolyzed in said pyrolyzer.

29. Apparatus according to claim 5 including means for introducing sulfur-rich fuel into said pyrolyzer while pyrolyzing said solid fuel.

30. Apparatus according to claim 5 including means for introducing sulfur-rich fuel into said furnace.

31. Apparatus according to claim 5 including a boiler having a combustion chamber for burning said combustible gases.

32. Apparatus according to claim 31 including means for introducing sulfur-rich fuel into said furnace.

33. Apparatus according to claim 5 including means for burning said combustible fuel.

34. Apparatus according to claim 33 including means for introducing sulfur-rich fuel into said means for burning said combustible gases.

35. A method for producing combustible gases from a product containing organic matter comprising:

a) adding said product to a reactor such that said product in the reactor is made up of an active fraction and a void fraction;

b) heating only said active fraction of the product in said reactor for producing combustible gases and carbonaceous material;

c) combusting said carbonaceous material to produce combustion products that include hot flue gases and ash particulate; and d) activating the void fraction in the reactor for producing combustible gases and carbonaceous material thereby reducing the residence time of said product in the reactor.

36. A method according to claim 35 wherein said product is a fuel.

37. A method according to claim 35 wherein said product includes raw phosphates.

38. A method according to claim 20 including burning the carbonaceous material for producing flue gases.

39. A method according to claim 38 wherein said void fraction in the pyrolyzer is activated with flue gases produced by burning said carbonaceous material.

40. A method according to claim 35 wherein said void fraction in the pyrolyzer is activated with said flue gases produced by said pyrolyzer.

41. Apparatus for producing combustible gases from a product containing organic material, said apparatus comprising:

a) means for converting said product to combustible gases and carbonaceous material;

b) means for burning said carbonaceous material and producing hot products that includes hot flue gases and ash particulate;

c) means for separating said hot products into a plurality of streams, one of which contains comparatively coarse ash, and another stream containing flue gases and comparatively fine ash;

d) means for directing said comparatively coarse ash produced by said separator into said means for converting; and f) means for activating the void fraction in the means for converting thereby reducing the residence time of said product in the pyrolyzer.

42. Apparatus according to claim 41 wherein said means for activating includes means for bubbling said flue gases through said product in said means for converting.

43. Apparatus according to claim 41 including means for burning said combustible gases, and producing flue gases, said means for activating includes means for bubbling flue gases through said products in said means for converting.

* * * * *